United States Patent [19]

Kaye

[11] 4,201,232

[45] May 6, 1980

[54] CIGARETTE HOLDER WITH FILTER

[75] Inventor: Paul Kaye, Farmington Hills, Mich.

[73] Assignee: Aquafilter Corporation, Fort Lauderdale, Fla.

[21] Appl. No.: 919,813

[22] Filed: Jun. 28, 1978

[51] Int. Cl.[2] ..... A24F 13/06

[52] U.S. Cl. ..... 131/187; 131/207; 131/261 R

[58] Field of Search ..... 131/187, 207, 10.1, 131/200–203, 173, 261 R

[56] References Cited

U.S. PATENT DOCUMENTS

| | | | |
|---|---|---|---|
| 2,796,869 | 6/1957 | Gerard et al. | 131/207 |
| 2,911,984 | 11/1959 | Gerard et al. | 131/173 |
| 3,048,180 | 8/1962 | Shaw | 131/207 |
| 3,428,049 | 2/1969 | Leake et al. | 131/10.1 |

*Primary Examiner*—Stephen C. Pellegrino

*Attorney, Agent, or Firm*—Wolf, Greenfield & Sacks

[57] ABSTRACT

A cigarette holder and filter cartridge combination including interconnected mouthpiece and cigarette holding sections which define a filter cartridge chamber and a filter cartridge, comprising a core of mixed absorbent and non-absorbent fibers and a cylindrical expandable paper wrapper, which when wet expands to fill the entire diameter of the filter cartridge chamber, thereby insuring that no smoke can reach the smoker by passing around the edges of the filter.

5 Claims, 6 Drawing Figures

CIGARETTE HOLDER WITH FILTER

BACKGROUND OF THE INVENTION

The present invention relates to a filter for cigarettes and the like and more particularly to a two-piece permanent cigarette filter with inexpensive disposable filter cartridges.

It has long been known that nicotine and tars in tobacco smoke have an adverse effect on the health of smokers. More and more cigarettes are being sold with built-in, dry cigarette filters. However, it has been found that hygroscopic filters such as those disclosed in U.S. Pat. Nos. 2,796,869, 2,911,984; 3,048,180, and 3,137,303 are even more effective in removing tars and nicotine from tobacco smoke. This is a considerable health benefit to those who wish to continue smoking and assists those who wish to stop smoking by reducing their customary nicotine intake to levels which they may more easily do without.

It is known that the best results with hygroscopic filters are achieved when they expand upon wetting to fill the entire chamber of their holder. However, it is difficult to ensure the proper fit of such an expandable filter in a permanent holder and prior art expandable filters, such as those disclosed in U.S. Pat. Nos. 3,048,180 and 3,137,303, have been in disposable holders.

Prior art permanent holders, such as those disclosed in U.S. Pat. Nos. 2,796,869 and 2,911,984, have bound their disposable filter cartridges by relatively expensive means, such as coating with pectin or encasement in a sleeve of foil or plastic, with a slit up the side of the sleeve to allow for expansion.

The present invention avoids the expense of making the holder disposable or encasing the filter in a special sleeve by introducing a particular grade of paper as a wrapper for the filter, which, when wet, will expand with the filter. Thus, there is provided an inexpensive, disposable filter cartridge which may be slipped into a two-piece permanent holder and moistened to expand it to the full dimensions of the chamber in the holder. No special reservoir or package of fluid, as in many prior art hydroscopic filters, is necessary because the filter of the present invention may be moistened with ordinary tap water after the two sections of the holder are joined together, such as by a set of conventional, circumferential screw threads. Any excess water may be expelled by blowing into the cigarette receiving end of the holder.

It is an object of the present invention to provide a hygroscopic filter and cigarette holder which will effectively filter the entire amount of smoke passing therethrough.

It is a further object of the invention to make the hygroscopic filter disposable and inexpensive.

Yet another object of the invention is to provide an expandable paper wrapper for a filter which will facilitate the insertion of the filter in a permanent holder without leaving any annular spaces surrounding the filter in the receiving chamber of the holder.

Still another object of the present invention is to provide a smoking filter for cigarettes or the like which removes a substantial portion of the dangerous tars and nicotine from the smoke, without materially reducing the moisture content thereof.

These and other objects and advantages of the present invention will be more clearly understood from a consideration of the accompanying drawing in which.

Figure 1:
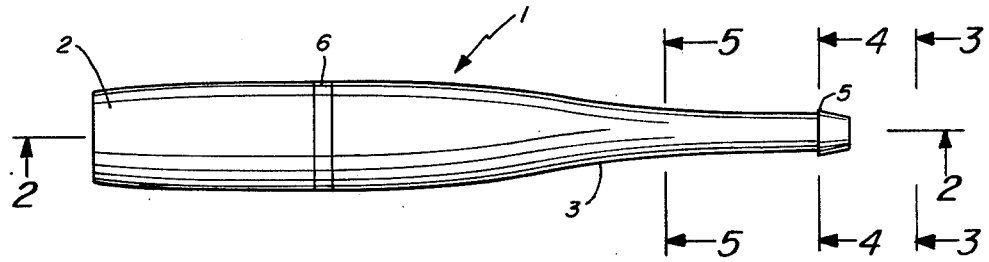
FIG. 1 is a plan view of the cigarette holder.
Figure 2:
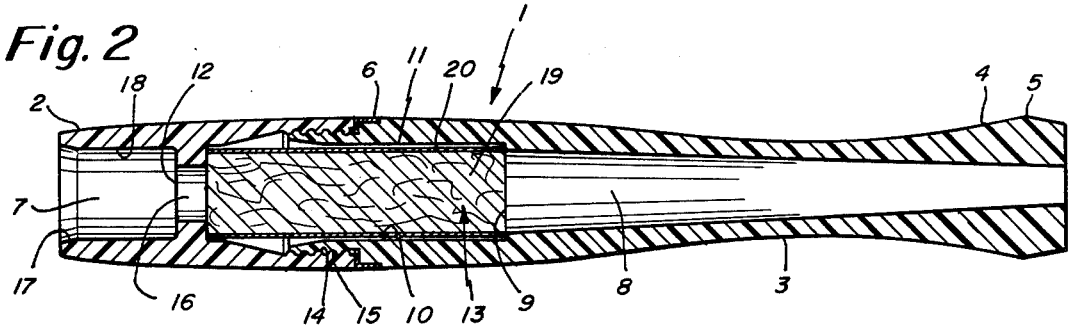
FIG. 2 is a horizontal cross-section of the holder of FIG. 1, showing the dry filter before addition of water.
Figure 3:
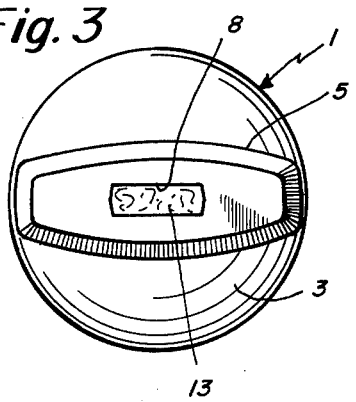
FIG. 3 is an end view of the holder taken along line 3—3 of FIG. 1.
Figure 4:
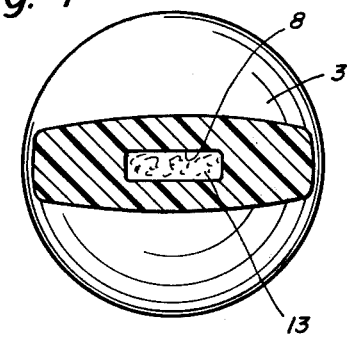
FIG. 4 is a cross-section taken along line 4—4 of FIG. 1.
Figure 5:
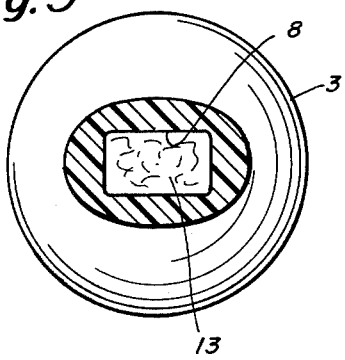
FIG. 5 is a cross-section taken along line 5—5 of FIG. 1.
Figure 6:
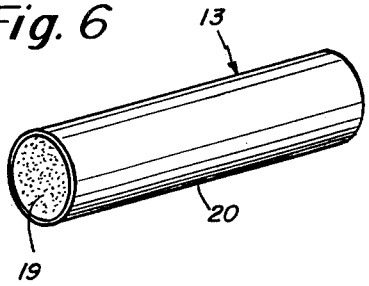
FIG. 6 is a perspective drawing of the filter.

As illustrated in the drawings, there is provided a housing 1 formed of injection moldable plastic material. The particular material of which the casing is made should be fire resistant and non-reactive with cigarette smoke, tars or nicotine, except insofar as minor surface discolorations may occur due to the action of the smoke, tars and nicotine. This housing 1 is essentially cylindrical at its forward end 2, and gradually tapers at its rear end into a mouth-piece section 3. The mouthpiece section 3 is substantially elliptical in cross-sectional shape, and is flared outwardly as illustrated at 4 at its rear edge. A ridge 5 is provided at the rear end of the filter for the purpose of providing an effective gripping area. A metal ring 6 is provided at the junction of sections 2 and 3 to prevent cracking if the two are screwed too tightly together. The housing is formed with a cylindrical opening 7 at its forward end 2 and a passage 8 continuous with the opening 7 extending through the mouthpiece section 3. An annular stop 9 formed in housing wall 10 defines one end of filter chamber 11. The other end of chamber 11 is defined by an annular shoulder 12. Filter 13 is inserted into the open chamber 11 of mouthpiece section 3 and the chamber 11 is then closed by screwing the female threads 14 of forward section 2 onto the male threads 15 of mouthpiece section 3. An opening 16 in annular shoulder 12 communicates with cigarette receiving opening 7, which has a tapered lip 17 to facilitate insertion of the cigarette and an inwardly off-set section 18 of such a diameter as to snugly fit a non-filter cigarette.

In the preferred embodiment, filter material 13 comprises a core 19, a mixture of absorbent and non-absorbent fibers admixed with a water-soluble adhesive, such as starch, which will break apart upon immersion in water, and a cylindrical expandable paper wrapper 20. A suitable fiber is cotton, as disclosed in U.S. Pat. No. 2,911,984. A suitable paper is one having a basis weight of between 23.7 and 26.3 gr/m$^2$, a tensile strength of at least 3.9 kg/3 cm, a porosity of between 29 and 52 ml/15 sec., with a filler of between 18 and 28% calcium carbonate. Many variations of these parameters are of course possible, and the above description should not be taken as limiting the scope of the invention here disclosed.

As described above, in use the filter is saturated with water by placing the holder momentarily under a running tap. Blowing through opening 7 will force out any excess water. The filter material is of such a nature that it expands outwardly when wet, and presses against the wall 10 of the chamber 11. Once the filter has been moistened, a non-filter cigarette is inserted into opening 7 and held snugly in the reduced diameter section 18. The cigarette is then ignited and the smoke is drawn through opening 16, filter 13 and passage 8 into the smoker's mouth. In the process, substantial amounts of tar and nicotine are removed from the smoke and remain in the filter, which remains effective for up to twenty cigarettes. At that point, the used filter is disposed of by unscrewing sections 2 and 3 of the holder and replacing the old filter with a new dry one, which is then moistened as before.

Although I have herein shown and described my invention in what I have conceived to be a most practical and preferred embodiment, it is recognized that departures may be made therefrom within the scope of my invention, which is not to be limited to the details disclosed herein, but is to be accorded the full scope of the claims, so as to embrace any and all equivalent structures and devices.

What is claimed is:

1. A cigarette holder and filter cartridge combination comprising:

a holder assembly including interconnected mouthpiece and cigarette holding sections which when connected define a cylindrical filter cartridge chamber connected at one end to a passage through the mouthpiece section and at the other end to an enlarged cigarette receiving opening at the other end, and a filter cartridge comprising:

a cylindrical core having a mixture of absorbent and non-absorbent fibers admixed with a water soluble adhesive and an expandible paper wrapper about the cylindrical surface of said core, said cartridge when dry having a diameter less than the diameter of said chamber and when wet having a diameter equal to the diameter of said chamber.

2. A cigarette holder and filter cartridge combination as set forth in claim 1, wherein:

said mouthpiece section tapers from a circular cross-section at one end to an essentially elliptical cross-section at its other end.

3. A cigarette holder and filter cartridge as set forth in claim 1, wherein said enlarged cigarette receiving opening is defined in part by an annular shoulder intermediate the ends of said cigarette holding section.

4. A cigarette holder and filter cartridge as set forth in claim 1, wherein said adhesive is a starch which breaks apart upon immersion in water.

5. A cigarette holder and filter cartridge combination comprising:

a holder assembly including interconnected mouthpiece and cigarette holding sections which when connected define a cylindrical filter cartridge chamber connected at one end to a passage through the mouthpiece section and at the other end to an enlarged cigarette receiving opening at the other end, and a filter cartridge comprising:

a cylindrical core having a mixture of absorbent and non-absorbent fibers admixed with a water soluble adhesive and an expandible paper wrapper about the cylindrical surface of said core, said cartridge when dry having a diameter less than the diameter of said chamber and when wet having a diameter equal to the diameter of said chamber, said paper wrapper comprising:

a weight of between 20 and 30 $g/m^2$, a tensile strength of at least 3.9 kg/3 cm, and a porosity of between 25 and 55 ml/15 sec.

* * * * *